United States Patent [19]

Binnersley et al.

[11] Patent Number: 4,816,327

[45] Date of Patent: Mar. 28, 1989

[54] FABRIC MADE FROM FLAT THERMOPLASTIC MELT IMPREGNATED TOW

[75] Inventors: Edward K. Binnersley, Wilmington, Del.; James M. Batman, Coopersburg, Pa.

[73] Assignee: E. I. Du Pont de Nemours and Company, Wilmington, Del.

[21] Appl. No.: 848,866

[22] Filed: Apr. 7, 1986

[51] Int. Cl.[4] ..... B32B 5/02

[52] U.S. Cl. ..... 428/225; 428/226; 428/227; 428/228; 428/257; 428/294

[58] Field of Search ..... 428/225, 226, 227, 228, 428/257, 294; 139/429

[56] References Cited

U.S. PATENT DOCUMENTS 3,930,091 12/1975 Lewis et al. ..... 428/226

*Primary Examiner*—Marion C. McCamish

[57] ABSTRACT

Formable twistless woven precursor fabrics, especially in satin or basket weave, made from flat tape of fiber reinforced thermoplastics on a power driven loom. The weft tape is supplied from a rotatable package that is driven in synchronism with the feeding mechanism and a finite tension on the tape is maintained.

2 Claims, 2 Drawing Sheets

FABRIC MADE FROM FLAT THERMOPLASTIC MELT IMPREGNATED TOW

BACKGROUND OF THE INVENTION

This invention relates to woven fabrics, and more particularly, it relates to fabrics woven from flat tape or tow of fiber reinforced plastic material.

Fiber-reinforced plastic structures have been used for many years with increasing success beause of their high strength, light weight and ease of fabrication compared to the wood or metal structures which they replace. Fibers such as glass, carbon and aramid are popular as reinforcement, and thermosetting resins such as polyester, phenolic and epoxy are common polymeric matrices. Such structures are disclosed by Moyer in U.S. Pat. No. 3,993,726 and by Binnersley et al. in U.S. Pat. No. 4,640,861.

Polymeric materials reinforced with continuous filaments such as disclosed by Moyer in U.S. Pat. No. 3,993,726 are used as precursors for highly-stressed parts such as aerospace components requiring the highest possible strength with the lowest possible weight. Non-uniformity of the materials comprising such parts requires that the parts be over-constructed so that the weakest will surpass the service requirements. More uniform precursor materials would yield parts having less variation in properties and would permit constructing such parts more efficiently to design criteria.

Weaving, to which this invention applies, comprises forming a fabric on a loom by interlacing warp and weft threads. The prior art includes many techniques for feeding the weft threads through the warp. Conventionally the weft is taken from a stationary package with an "over the end of the package takeoff" which results in twist being formed in the weft.

When weaving such reinforced tape in satin weave and basket weave fabric constructions under such weaving conditions the weft tape will likely have twist formed during the weaving operation. Such twist would represent an undesirable nonuniformity in the fabric. Therefore, the production of woven fabrics from tape of fiber reinforced plastic without such twisting would be highly desirable.

SUMMARY OF THE INVENTION

This invention provides a method for producing woven fabrics from flat tape of fiber reinforced plastic on a power driven loom having warp and weft directions. The weft tape is supplied from a rotatable package and is fed in synchronism with the device that feeds the tape through the weft and is tensioned and guided to maintain the tape in the plane of the fabric throughout the fabric without twist. The warp and weft tapes are arranged so that a line parallel to the surface of each of the tapes and perpendicular to its longitudinal axis is in the plane of the fabric in the warp and weft directions throughout the fabric.

DETAILED DESCRIPTION OF THE ILLUSTRATED EMBODIMENT

Figure 1:
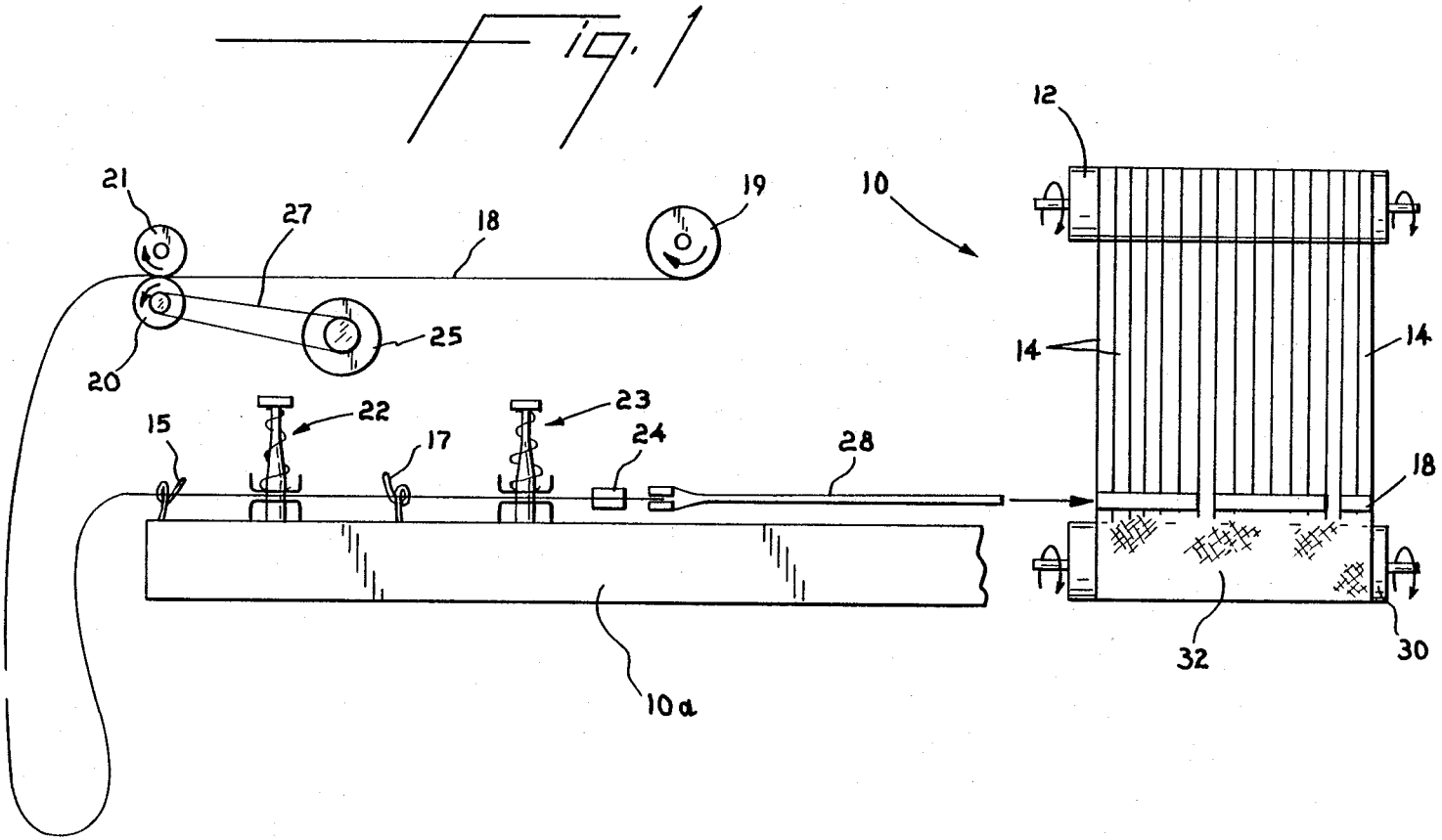
FIG. 1 is a schematic elevation of the weft feeder mechanism used in conjunction with a loom to perform the method of this invention.

Referring to FIG. 1, a loom generally designated as 10 is fed from a warp set of fiber reinforced plastic tapes 14 wound without twist on rotatably driven beam 12. The tapes 14 pass in the usual well known manner toward a rotatably driven fabric takeup beam 30 which winds the woven fabric 32 thereon. A flat fiber reinforced plastic tape 18 used for the weft direction of the fabric is withdrawn from a rotatable supply package 19 by a pair of nip rolls 20,21 into an accumulation loop and from the loop fed to the rapier 28 of the loom through guides 15,17 tensioners 22,23, and feeder guide positioner 24. The weft tape 18 is then interlaced through the warp tapes 14 in the usual manner to form the fabric 32.

The nip roll 20 is driven by variable speed motor (Zero Max-model M-2) 25 via belt 27. The motor speed is adjusted to synchronize the feeding means (nip rolls 20,21) with the movement of rapier 28.

Figure 2:
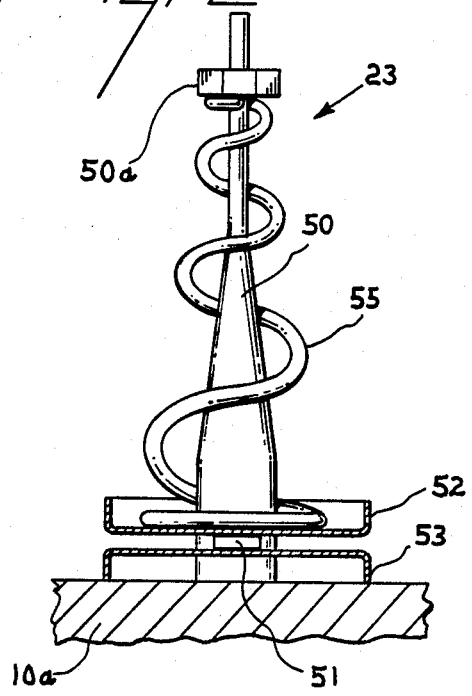
FIG. 2 is an enlargement of a tensioner of FIG. 1.

The tensioners 22,23 (FIG. 2) are comprised of a center post 50, attached to the lay of the loom 10*a*. The center post has a slot 51 through which tape 18 passes. Two tension discs 52,53 are positioned by post 50 and disc 52 is biased toward disc 53 by spring 55 located between disc 52 and stop nut 50*a* on post 50.

Figure 3:
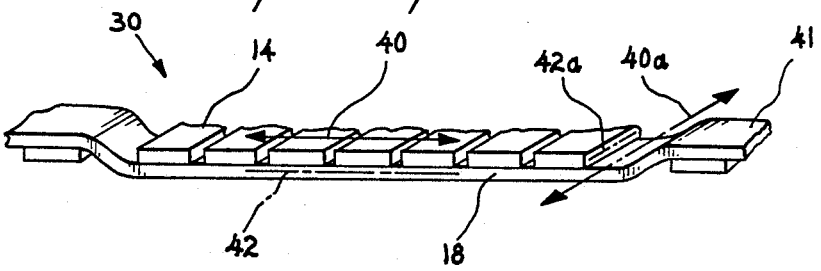
FIG. 3 is a schematic representation of an 8-harness satin fabric made using the method of this invention.

Referring now to FIG. 3, a small portion of the fabric 30 of this invention is shown schematically in perspective to illustrate what is meant by twistless warp or weft tape. More particularly, as illustrated, a line 40*a* is drawn parallel to the surface 41 of weft tape 18 and perpendicular to the longitudinal axis 42 of the tape. If the weft tape is flat throughout the fabric and without twist, then line 40*a* drawn at any point along the weft will be in the plane of the fabric. The same applies to the warp tapes 14 using a line 40 perpendicular to longitudinal axis 42*a*.

EXAMPLE

Eight woven fabrics are prepared using an IWER Series 1500 Rapier Loom. Each fabric is woven from warp and weft tapes and is of woven constructions as detailed in Table I. The tapes have nominal thickness of 5 to 12 mils and a width of about 3/16" and comprise reinforcing fibers such as carbon, Kevlar® and glass impregnated with a thermoplastic resin. The particular resin used was a copolyamide from hexamethylene diamine, bis(para-aminocyclohexyl)methane, isopthalic acid and terephthalic acid disclosed by Chang in U.S. patent application Ser. No. 819,562 filed Jan. 17, 1986.

TABLE I

| Sample No. | Weave Type | Fiber Reinforc. | Picks/in Warp | Picks/in Weft | Weight Oz/yd$^2$ |
|---|---|---|---|---|---|
| A | 4 × 4 basket | graphite | 5.9 | 11.4 | 6.5 |
| B | 4 Harness satin | graphite | 5.8 | 11.5 | 6.3 |
| C | 4 × 4 basket | Kevlar® | 6.1 | 7.2 | 6.2 |
| D | 4 Harness satin | Kevlar® | 6.0 | 7.1 | 6.2 |
| E | 4 × 4 basket | Glass | 3.6 | 4.8 | 10.0 |
| F | 4 Harness satin | Glass | 4.0 | 4.8 | 10.0 |
| G | 8 Harness satin | Kevlar® | 8.0 | 7.8 | 7.7 |
| H | 8 Harness satin | Glass | 6.0 | 5.8 | 13.6 |

In Samples G and H the edges of the tapes in the warf and weft directions were abutting and exhibited no twist.

An 8-harness satin fabric, made of Sample G above, was formed into a composite by heating 8 layers of the fabric in an infra-red oven between two glass layers precoated with Fre kate® 33 to a temperature of 370° C. The layers were then placed on top of a 6-inch hemispherical mold and the perimeter of the layers was securely clamped. The molding conditions were 150° C. at a pressure of 30 tons. The mold was then cooled to 110° C. under pressure and opened. The period for molding and cooling was about 20 minutes.

A series of plaques formed of plies of 8-harness satin woven fabric of sample G were made as detailed in Table II.

TABLE II

| | | | |
|---|---|---|---|
| No. Plies | 6 | 16 | 6 |
| Size of Ply | 6" × 6" | 6" × 6" | 6" × 6" |
| Orientation | 0/90 | $[90/0]_{4S}$ | 0/90 |
| Laminate Thickness | 43 mils (.043) | 114 mils | 42 mils |
| Consolidation Conditions* | | | |
| TEMP. | 295–305° C. | 295–305° C. | 295–305° C. |

TABLE II-continued

| | | | |
|---|---|---|---|
| PRESSURE | 305 psi | 305 psi | 305 psi |
| TIME | 30 min. | 30 min. | 30 min. |

*Cooled under pressure

The fabric, which consists of tape the surfaces of which remain parallel to the plane of the fabric throughout the fabric without twist, when formed into composites such as laminates or molded parts by thermoforming processes demonstrated conformability and uniformity.

We claim:

1. A machine woven fabric of flat tape of polymeric material reinforced with continuous filaments in both the warp and weft directions, said warp and weft tapes, being arranged so that a line parallel to the surface of each of the tapes and perpendicular to its longitudinal axis is in the plane of the fabric throughout the fabric, said warp and weft tapes having edges that are abutting substantially throughout the fabric.

2. A composite of the fabric of claim 2.

* * * * *